US006256962B1

(12) United States Patent
Boeshart

(10) Patent No.: US 6,256,962 B1
(45) Date of Patent: Jul. 10, 2001

(54) TIE FOR REUSABLE FORM PANELS

(76) Inventor: Patrick E. Boeshart, P.O. Box 774, Sioux City, IA (US) 51100

( * ) Notice: Subject to any disclaimer, the term of this patent is extended or adjusted under 35 U.S.C. 154(b) by 0 days.

(21) Appl. No.: 09/481,623

(22) Filed: Jan. 12, 2000

(51) Int. Cl.[7] ..... E04G 21/02; E04G 11/08; E04G 17/06

(52) U.S. Cl. ..... 52/745.09; 249/41; 249/214

(58) Field of Search ..... 249/38, 40, 41, 249/190, 214, 216; 52/745.09

(56) References Cited

U.S. PATENT DOCUMENTS

| | | | | |
|---|---|---|---|---|
| 1,126,190 | * | 1/1915 | Fuehrer | 249/214 |
| 1,577,343 | * | 3/1926 | Miller | 249/216 |
| 3,995,825 | * | 12/1976 | Ward et al. | 249/41 |
| 4,154,362 | | 5/1979 | McKenney | 220/334 |
| 4,563,381 | | 1/1986 | Woodland | 428/156 |
| 4,889,310 | * | 12/1989 | Boeshart | 249/41 |
| 5,039,058 | | 8/1991 | Boeshart | 249/194 |
| 5,890,337 | * | 4/1999 | Boeshart | 249/41 |

* cited by examiner

*Primary Examiner*—Michael Safavi
(74) *Attorney, Agent, or Firm*—Koley Jessen P.C., A Limited Liability Organization; Mark D. Frederiksen

(57) ABSTRACT

A tie for interconnecting a pair of parallel form panels includes an elongated strap with an end plate pivotally connected at each end of the strap, permitting the end plate to be pivoted from a position generally orthogonal to the strap to a position generally parallel to the strap. Once an end plate is pivoted to a position parallel to the strap, the end plate is pushed through a polystyrene form panel to project therefrom. The end plate is then pivoted to a position orthogonal to the strap, and pulled into engagement with the outer face of the form panel. The second end plate is pivoted, pushed through a second form panel, and pivoted to the orthogonal position, in the same manner. Concrete is then poured between the panels and allowed to harden. After the concrete is cured, a form panel may be removed by striking the end plate with a rubber mallet in a direction aligned with the longitudinal axis of the strap. This causes the hinge between the end plate and strap to break, and the end plate to fall to the ground. Once the end plates are removed, the form panel will slide off the projecting ends of the tie straps. The projecting ends of the tie strap are preferably substantially solid plastic, to permit residue and concrete from forming in the form panel slots.

14 Claims, 3 Drawing Sheets

TIE FOR REUSABLE FORM PANELS

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1). Field of the Invention

The present invention relates generally to ties for connecting form panels to create a poured concrete wall system, and more particularly to an improved tie which is mechanically operable to be inserted through a form panel and then manipulated to retain the form panel in position, and a method for removing the form panel after the concrete has cured.

(2). Background Information

A popular wall forming system utilizes expanded polystyrene panels as forms for poured concrete walls. After the concrete has hardened, the panels may be left in place on the walls to serve as permanent insulation, or they may be stripped off to reveal the exposed concrete and permit reuse of the form panels.

Initially, these lightweight concrete forming systems utilized elongated one foot high sheets with tie slots formed along the upper and lower edges. The panels then were connected by plastic ties, the panels oriented parallel to one another and stacked vertically.

In order to permit use of a large four foot by eight foot panel as a concrete form panel, the inventor herein created a tie with an elongated connector strap and hinged end plates. The end plates could be pivoted to a position parallel to the strap, forming a small cross-section which could be easily pushed through the form panel. The end plate is then manipulated to a perpendicular position and pulled against the form panel to retain the form panel from movement outwardly off of the tie.

With both the initial systems and the four by eight sheet systems, the procedure for removing the form panels from the cured concrete wall was the same: a sharp vertical blow was applied to the end plate to break the end plate and permit removal of the form panel. A scraper was then used to scrap the projecting legs which initially interconnected the outer end plate with an inner retainer plate.

While both of these ties permitted removal of the form panels from the cured concrete wall, it was found that the large openings between the legs connecting the end plate with a retainer plate filled with residue and concrete which migrated during the pouring of the concrete. This in turn stayed within the slots formed in the form panels when the form panels were removed from the wall. Thus, it was necessary to clean out all of the slots in the form panels before the panels could truly be reused.

In addition, the vertical blow utilized to knock the end plate from the tie strap legs frequently damaged the exterior surface of the form panel. This occurred not only by the vertical blow applied to the plate, but by the affects of the scraper or hammer contacting the surface of the form panel, and gouging groves and the like in the form panel.

BRIEF SUMMARY OF THE INVENTION

It is therefore a general object of the present invention to provide an improved tie for use with polystyrene sheets used as form panels for poured concrete walls.

Another object of the present invention is to provide an improved method for removing the end plates from the ties, to permit reuse of the form panels.

A further object is to provide an improved tie for a concrete wall form system which significantly reduces residue remaining within slots formed in the form panels by the tie ends.

These and other objects of the present invention will be apparent to those skilled in the art.

The tie for interconnecting a pair of parallel form panels of the present invention includes an elongated strap with an end plate pivotally connected at each end of the strap, permitting the end plate to be pivoted from a position generally orthogonal to the strap to a position generally parallel to the strap. Once an end plate is pivoted to a position parallel to the strap, the end plate is pushed through a polystyrene form panel to project therefrom. The end plate is then pivoted to a position orthogonal to the strap, and pulled into engagement with the outer face of the form panel. The second end plate is pivoted, pushed through a second form panel, and pivoted to the orthogonal position, in the same manner. Concrete is then poured between the panels and allowed to harden. After the concrete is cured, a form panel may be removed by striking the end plate with a rubber mallet in a direction aligned with the longitudinal axis of the strap. This causes the hinge between the end plate and strap to break, and the end plate to fall to the ground. Once the end plates are removed, the form panel will slide off the projecting ends of the tie straps. The projecting ends of the tie strap are preferably substantially solid plastic, to permit residue and concrete from forming in the form panel slots.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
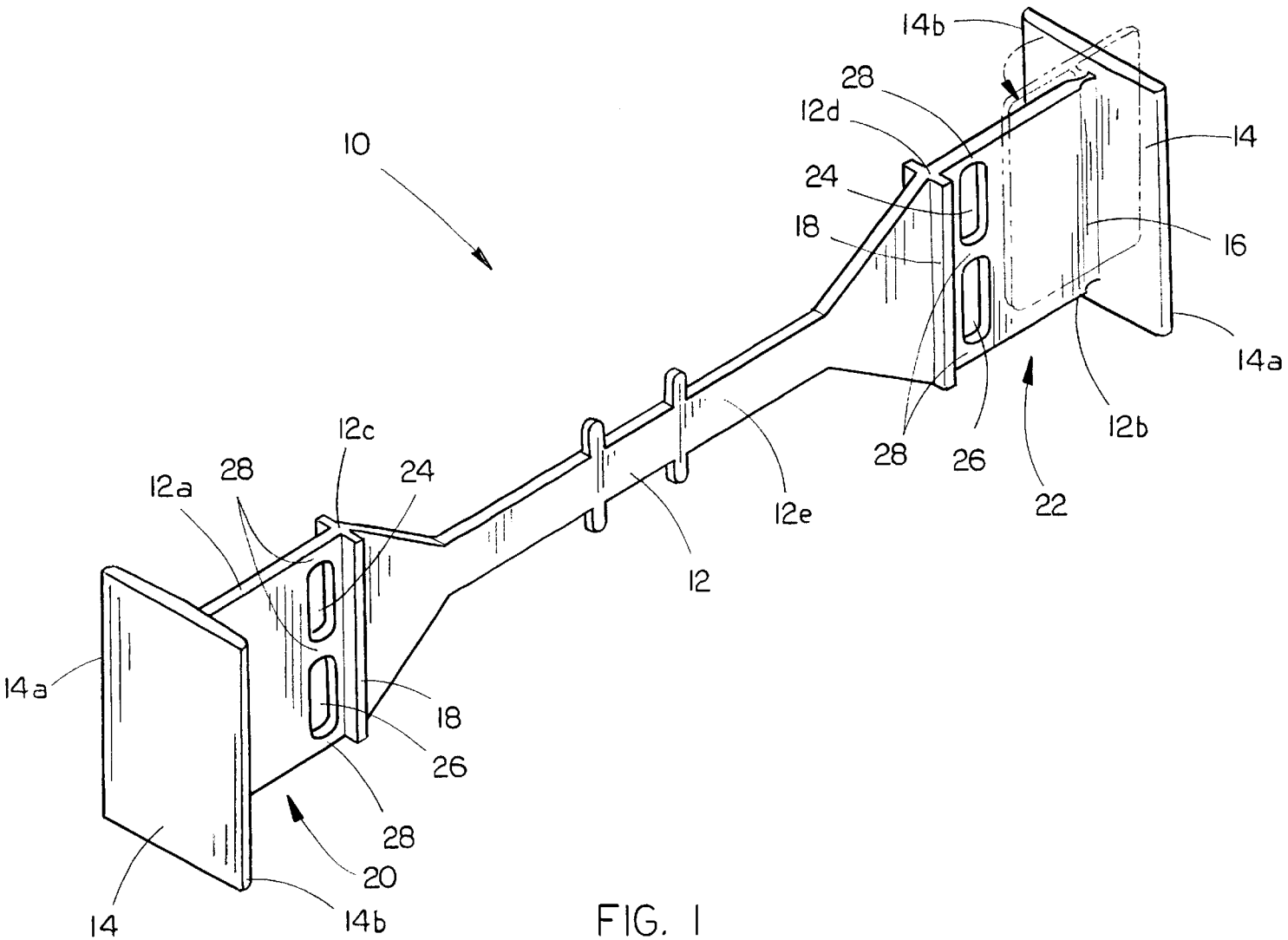
FIG. 1 is a perspective view of the tie of the present invention.

Referring now to the drawings, and more particularly to FIG. 1, the tie of the present invention is designated generally at 10 and includes an elongated strap 12 of a synthetic plastic material. Preferably, strap 12 is of a thin material, so as to have a height substantially greater than its thickness. Strap 12 includes opposing ends 12*a* and 12*b*, each end having an end plate 14 operably mounted thereon with a hinge 16. Preferably, end plates 14 and hinges 16 are also formed of synthetic plastic material, such that tie 10 is a single integral piece.

In the preferred embodiment, hinges 16 are "living hinges" formed of a thinned plastic joint between each end plate and the associated strap end 12*a* and 12*b*. In the preferred form of the invention, each hinge is thinned to a thickness of approximately 0.021 inches. Hinges 16 are oriented vertically, such that each end plate 14 may be pivoted from a first position oriented generally orthogonal to the longitudinal axis of the strap 12, as shown at end 12*a*, to a position generally parallel to the longitudinal axis of strap 12, as shown by the broken line drawing at end 12*b*. End plates 14 are mounted on hinges 16 along a vertical axis located generally centrally between side edges 14*a* and 14b, to permit pivoting of end plates 14 in either direction.

Strap 12 preferably has a height, measured between upper and lower edges, which is constant from the outer ends 12*a* and 12*b* to an interior point identified generally at 12*c* and 12*d* respectively. A small retainer plate 18 is formed orthogonal to the longitudinal axis of strap 12 at each interior point 12*c* and 12*d*, and projects a short distance from opposing faces of strap 12. The distance from each retainer plate 18 to the associated end plate 14 is preferably equal to the thickness of a form panel (shown in FIG. 2) through which the tie 10 will be inserted. The overall height of strap 12 is preferably reduced as it extends inwardly from retainer plates 18, so that the central portion 12*e* of strap 12 is of a relatively short height, approximately one-fourth the height of the end portions of the strap.

The end sections of strap 12, located between the retainer plates 18 and end plates 14, are identified generally at 20 and 22 respectively, are preferably formed of a panel of solid plastic material. A pair of vertically aligned and spaced apart elongated narrow upper and lower slots 24 and 26 are formed through each end section 20 and 22 immediately adjacent and parallel to retainer plates 18. Slots 24 and 26 are positioned between upper and lower edges of the strap 12 to form short legs 28 between the slots, above the upper slots 24 and below the lower slots 26. As described in more detail hereinbelow, the use of short legs 28 permits simpler and cleaner removal of end sections 20 and 22 after the form panels have been removed from a cured concrete wall.

In use, each polystyrene form panel sheet 30 (shown in FIG. 2) is preferably marked with locations for the installation of ties 10. One end plate 14 is then pivoted to a position parallel to strap 12, as shown in broken lines in FIG. 1, and then manually pushed through the form panel to project out the opposite side of the form panel 30. The end plate 14 is then repositioned to an orientation orthogonal to strap 12 and the form panel 30 is pushed outwardly against the inward surface of end plate 14. The same procedure is utilized for the opposite end of tie 10, so that each tie will retain form panels 30 from outward movement along the longitudinal axis of strap 12.

Retainer plates 18 provide some resistance against inward movement of the form panels 30, while concrete is poured between the form panels. The pressure of the concrete between the form panels will maintain the form panels forced outwardly flush against end plates 14. Once the concrete has cured, form panels 30 may either be left in place to insulate the concrete wall, or they may be removed and reused, as described in more detail below.

Figure 2:
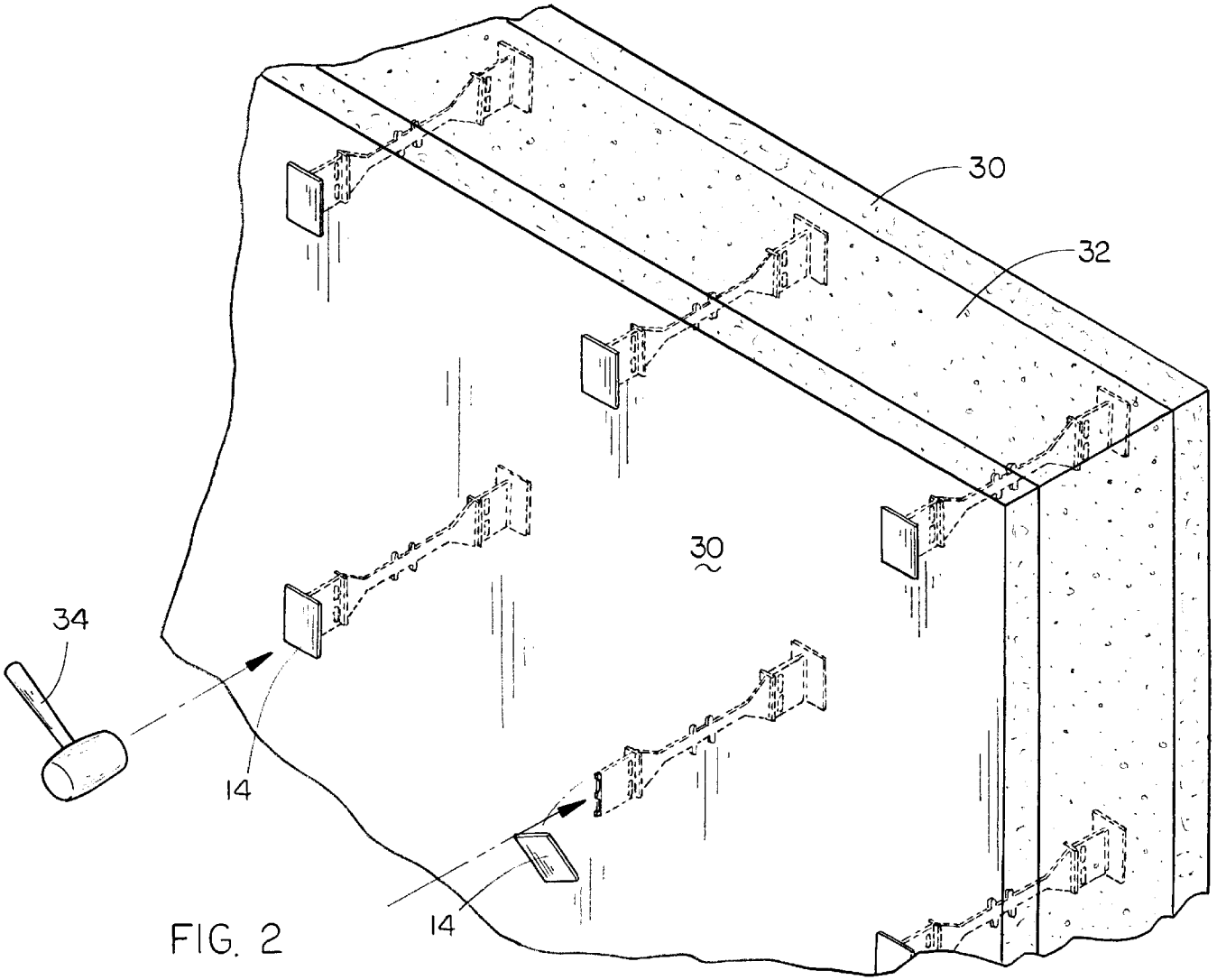
FIG. 2 is a perspective view of a wall utilizing the ties of the forming system thereon, showing how the outer plate of the tie is removed.
Figure 3:
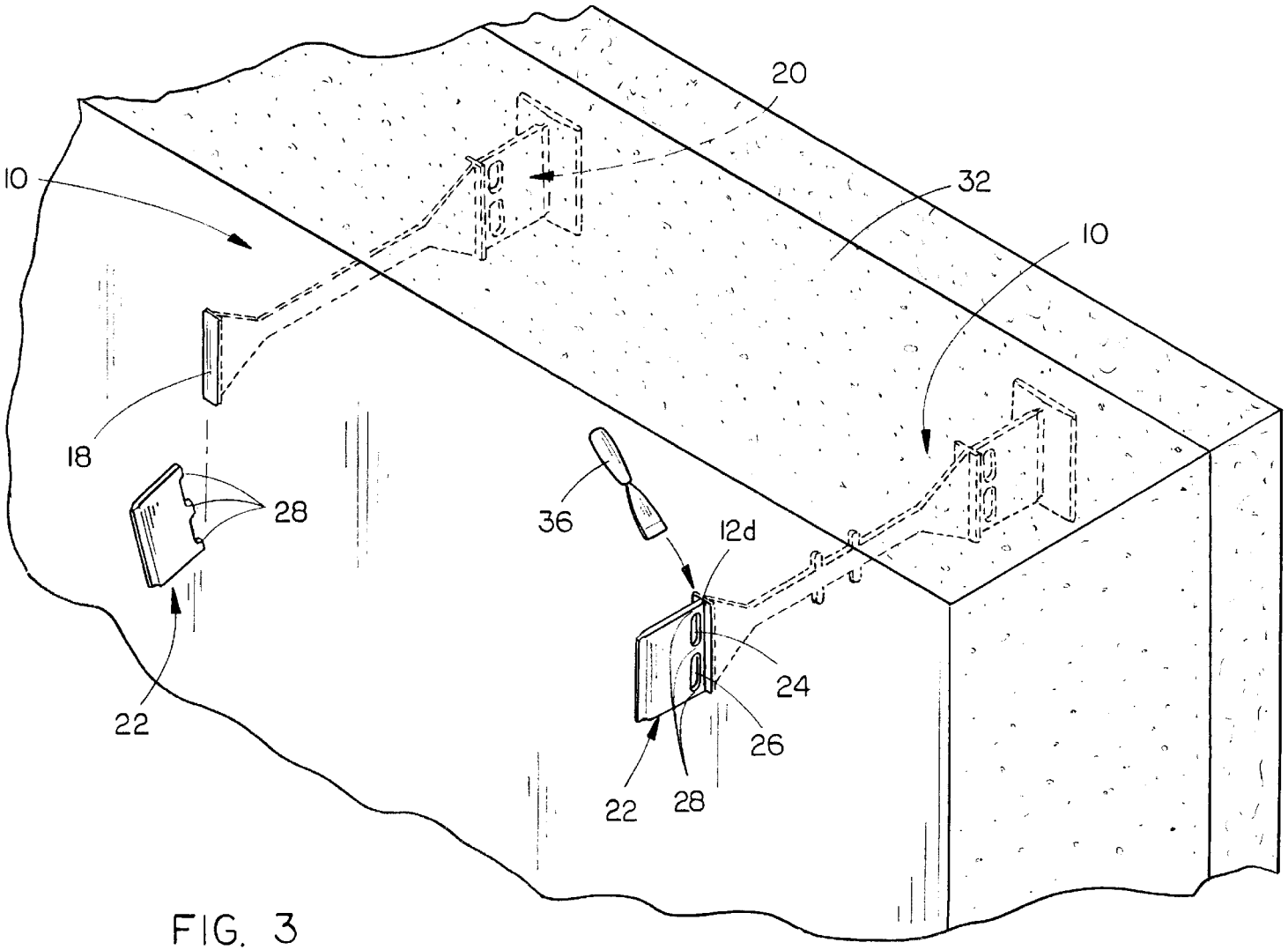
FIG. 3 is a perspective view of the wall of FIG. 2 with the form panels removed, showing the removal of the projecting ends of the ties.

FIGS. 2 and 3 show how form panels 30 may be removed from a hardened concrete wall 32. FIG. 2 shows how a rubber mallet 34 is utilized to apply a sharp horizontal blow to end plate 14, which is exposed on the outside surface of each form panel 30. Contrary to the applicant's prior methods of removing outer plates 14, the blow is directed generally aligned along the longitudinal axis of the strap, much in the same manner that a nail head is pounded by a hammer. The inventor has found that the synthetic plastic material of the thinned portion of hinge 16 will suffer a catastrophic failure upon the sharp compression caused by the blow by mallet 34 along the longitudinal axis of the strap. This failure permits end plates 14 to drop and fall to the ground. Because the blow is applied directly toward the surface of form panel 30, there are no sharp edges which could gouge the form panel and harm the surface of the panel. Once end plates 14 are removed from the entire panel 30, the panel may be pulled outwardly away from wall 32 and removed.

As shown in FIG. 3, each end section 20 and 22 will remain projecting from wall 32. Because end sections 22 are substantially solid, no residue or concrete remains in the slots formed in the form panel, thereby permitting immediate reuse of the form panel.

FIG. 3 shows wall 32 with the form panels removed, with end sections 20 and 22 projecting therefrom. A conventional scraper 36 is shown in use cutting through the projecting legs 28 formed by slots 24 and 26, to permit simple removal. Once removed, only the cross-section of the tie strap at the retainer plate 18 remains.

Whereas the invention has been shown and described in connection with the preferred embodiment thereof, many modifications, substitutions and additions may be made which are within the intended broad scope of the appended claims.

I claim:

1. A tie for interconnecting a pair of parallel form panels, comprising:

an elongated strap having opposing first and second ends, and a longitudinal axis;

a first end plate pivotally connected to the strap first end for pivotal movement between a first position generally orthogonal to the strap longitudinal axis, and a second position generally parallel to the strap longitudinal axis;

a second end plate mounted on the strap second end, oriented generally orthogonal to the strap longitudinal axis; and a vertically oriented hinge pivotally connecting the first end plate to the strap first end;

said strap, hinge and end plates being formed of a synthetic plastic material and formed as a single integral unit;

said hinge being formed of a thinned portion of plastic material to form a living hinge, a thickness such that a sharp blow directed along the longitudinal axis of the strap on an outward face of the first end plate will break the hinge.

2. The tie of claim 1, wherein the second end plate is pivotally connected to the strap second end, for pivotal movement between a first position generally orthogonal to the strap longitudinal axis, and a second position generally parallel to the strap longitudinal axis.

3. The tie of claim 2, further comprising a second vertically oriented hinge pivotally connecting the second end plate to the strap second end, and wherein:

said second hinge is formed of a thinned plastic material to form a living hinge; and said second hinge has a thickness such that a sharp blow directed along the longitudinal axis of the strap on an outward face of the second end plate will break the second hinge.

4. The tie of claim 3, wherein said strap has upper and lower edges and opposing first and second end sections extending inwardly from the end plates, and wherein the first end section includes a pair of upper and lower vertically-aligned, elongated, vertically-oriented slots, spaced inwardly from the first hinge and parallel to the hinge, said upper and lower slots forming an upper leg between the upper slot and strap upper edge, a central leg between the slots, and a lower leg between the lower slot and the strap lower edge.

5. The tie of claim 4, wherein the second end section includes a pair of upper and lower vertically-aligned, elongated, vertically-oriented slots, spaced inwardly from the second hinge and parallel to the second hinge, said second section slots forming an upper leg between the upper slot and the strap upper edge, a central leg between the slots, and a lower leg between the lower slot and the strap lower edge.

6. The tie of claim 3, wherein the strap has upper and lower edges and opposing first and second end sections extending inwardly from the end plates, and wherein the first end section includes an elongated slot spaced inwardly from the first hinge and parallel to the hinge, and forming an upper leg between the slot and the strap upper edge and a lower leg between the slot and the strap lower edge.

7. The tie of claim 6, wherein the strap second end section includes an elongated slot spaced inwardly from the second hinge and parallel to the hinge, and forming an upper leg between the slot and the strap upper edge and a lower leg between the slot and the strap lower edge.

8. In combination:

a pair of parallel, spaced apart form panels, each form panel having inward and outward faces and a thickness therebetween; and a tie interconnecting the form panels, comprising:

an elongated strap having opposing first and second ends, and a longitudinal axis;

a first end plate pivotally connected to the strap first end for pivotal movement between a first position generally orthogonal to the strap longitudinal axis, and a second position generally parallel to the strap longitudinal axis;

a second end plate mounted on the strap second end, oriented generally orthogonal to the strap longitudinal axis; and a vertically oriented hinge pivotally connecting the first end plate to the strap first end;

said strap, hinge and end plates being formed of a synthetic plastic material and formed as a single integral unit;

said hinge being formed of a thinned portion of plastic material to form a living hinge, a thickness such that a sharp blow directed along the longitudinal axis of the strap on an outward face of the first end plate will break the hinge.

9. The combination of claim 8, wherein the second end plate is pivotally connected to the strap second end, for pivotal movement between a first position generally orthogonal to the strap longitudinal axis, and a second position generally parallel to the strap longitudinal axis.

10. The combination of claim 9, further comprising a second vertically oriented hinge pivotally connecting the second end plate to the strap second end, and wherein:

said second hinge is formed of a thinned plastic material to form a living hinge; and said second hinge has a thickness such that a sharp blow directed along the longitudinal axis of the strap on an outward face of the second end plate will break the second hinge.

11. The combination of claim 10, wherein:

said strap includes upper and lower edges and opposing first and second end sections extending inwardly form the end plates;

said strap end sections each extend through a slot formed in each form panel, with each end plate positioned against an outward face of a form panel and each end section substantially filling each form panel slot;

each end section includes at least one vertically-oriented slot parallel to the hinges and spaced inwardly of the associated end plates, to form at least upper and lower legs of small cross-section connecting the end sections to the remainder of the strap.

12. The combination of claim 11, wherein each end section is substantially solid between each end section slot and each end plate.

13. A method for removing a form panel from a concrete wall of the type having a plurality of plastic ties with end plates on opposing ends of a plastic strap retaining the form panel on the wall and wherein each strap end plate is connected to the strap with a thinned plastic hinge, comprising the steps of:

applying a dynamic blow to each tie end plate securing the panel in position on the wall, directed generally along a longitudinal axis of the tie straps, to break the hinges;

removing the end plates; and pulling the form panel outwardly away from the wall, off of the tie straps.

14. The method of claim 13, wherein each tie includes opposing end sections extending inwardly from the end plates, each end section extending through and substantially filling a slot in each form panel, and wherein the step of pulling the form panel outwardly includes sliding the form panel off of one of the end sections of each tie to leave empty slots in the form panel.

* * * * *